US009635985B2

(12) United States Patent
Phelps

(10) Patent No.: US 9,635,985 B2
(45) Date of Patent: May 2, 2017

(54) SPINDLE FOR ROLL PAPER PRODUCTS

(75) Inventor: Stephen Lawrence Phelps, Lilburn, GA (US)

(73) Assignee: SOLARIS PAPER, INC., Alpharetta, GA (US)

( * ) Notice: Subject to any disclaimer, the term of this patent is extended or adjusted under 35 U.S.C. 154(b) by 138 days.

(21) Appl. No.: 13/288,257

(22) Filed: Nov. 3, 2011

(65) Prior Publication Data

US 2012/0104142 A1 May 3, 2012

Related U.S. Application Data

(60) Provisional application No. 61/409,616, filed on Nov. 3, 2010.

(51) Int. Cl.

| | |
|---|---|
| ***A47K 10/40*** | (2006.01) |
| ***A47K 10/38*** | (2006.01) |
| *B65H 75/24* | (2006.01) |

(52) U.S. Cl.

CPC ..... *A47K 10/40* (2013.01); *A47K 10/3836* (2013.01); *B65H 75/242* (2013.01)

(58) Field of Classification Search

CPC ..... A47K 10/40; A47K 2010/3206; A47K 10/3836; B65H 75/08; B65H 75/241; B65H 75/242

USPC ..... 242/599–599.1, 598–598.4

See application file for complete search history.

(56) References Cited

U.S. PATENT DOCUMENTS

| | | | |
|---|---|---|---|
| 1,391,326 | A | 9/1921 | Killian |
| 1,778,856 | A | 10/1930 | Hoegger |
| 2,209,471 | A | 7/1940 | Olken et al. |
| 2,289,453 | A | 7/1942 | Randall |
| 2,289,519 | A | 7/1942 | Randall |
| 2,331,743 | A | 10/1943 | Sullivan |
| 2,621,867 | A | 12/1952 | Grettve |
| 2,762,575 | A | 9/1953 | Miller |

(Continued)

FOREIGN PATENT DOCUMENTS

| | | |
|---|---|---|
| GB | 731449 | 6/1955 |
| WO | 2009/027873 | 3/2009 |

OTHER PUBLICATIONS

Patent Cooperation Treaty, "Notification of Transmittal of the International Search Report and the Written Opinion of the International Searching Authority, or the Declaration", PCT Application No. PCT/US12/63393, issued Mar. 22, 2013.

*Primary Examiner* — Emmanuel M Marcelo
*Assistant Examiner* — Michael Gallion
(74) *Attorney, Agent, or Firm* — Fish & Tsang, LLP

(57) ABSTRACT

An expandable and contractible spindle for dispensing rolled paper product, such as toilet paper, is described. The spindle comprises two elongated housings slideably coupled together, and a spring disposed there between. The first housing has a hallow interior portion and a side opening that provides access to the interior. The second housing has at least three sections with different diameters. The first section has a diameter that fits into the hollow interior of the first housing, but is too large to exit the side opening. The second section has a diameter smaller than the side opening. The third section has a diameter larger than the side opening. In this manner, first housing slides with respect to second housing along the length of the second section of second housing. The spring is disposed in the hallow interior, causing the spindle to expand.

18 Claims, 7 Drawing Sheets

(56) References Cited

U.S. PATENT DOCUMENTS

| | | | | | |
|---|---|---|---|---|---|
| 3,601,328 | A | * | 8/1971 | McClung | 242/599 |
| 3,643,884 | A | * | 2/1972 | Curtin | 242/598.4 |
| 3,770,221 | A | | 11/1973 | Stern | |
| 4,212,434 | A | | 7/1980 | Walker | |
| 4,422,585 | A | | 12/1983 | Schultz et al. | |
| 4,447,015 | A | | 5/1984 | Peterson | |
| 5,165,620 | A | * | 11/1992 | Kampiziones | 242/573.2 |
| D340,822 | S | | 11/1993 | Morand | |
| 5,340,047 | A | | 8/1994 | Heller | |
| 5,370,336 | A | | 12/1994 | Whittington | |
| 5,374,008 | A | * | 12/1994 | Halvorson et al. | 242/598.3 |
| 5,467,935 | A | | 11/1995 | Moody | |
| 5,495,997 | A | | 3/1996 | Moody | |
| 5,669,576 | A | * | 9/1997 | Moody | 242/560.3 |
| 6,367,734 | B1 | * | 4/2002 | Cartwright | 242/599.1 |
| 6,402,085 | B1 | * | 6/2002 | Smith | 242/578 |
| 6,422,505 | B1 | | 7/2002 | Froesel | |
| 6,688,551 | B1 | * | 2/2004 | He et al. | 242/599 |
| 7,213,783 | B1 | | 5/2007 | Schmatz | |
| 7,416,153 | B1 | * | 8/2008 | Dervin | 242/599.1 |
| 2002/0134881 | A1 | * | 9/2002 | Hoernig | 242/599.1 |
| 2004/0144884 | A1 | * | 7/2004 | He et al. | 242/599 |
| 2007/0012814 | A1 | * | 1/2007 | Burnett | 242/599 |
| 2008/0001020 | A1 | * | 1/2008 | Burnett | 242/599 |
| 2008/0142542 | A1 | * | 6/2008 | Petry | 221/283 |

* cited by examiner

SPINDLE FOR ROLL PAPER PRODUCTS

This application claims the benefit of priority to U.S. provisional patent application Ser. No. 61/409,616, filed on Nov. 3, 2010.

FIELD OF THE INVENTION

The field of the invention is dispensers, more specifically, expandable and contractible spindles for roll paper products.

BACKGROUND

Expandable and contractible spindles are commonly used for winding and unwinding rolled products. Typical household spindles for dispensing toilet paper consists of three parts: two hollow elongated members and a spring. The two elongated members are sufficiently flexible such that one member can snap fit inside the other. The spring is located inside both members and applies a constant pressure to the elongated members, forcing them away from each other axially. In this manner, the spindle can be collapsed, placed in between a pair of arms or walls, and expanded into recesses of the arms or walls, thus securing the spindle in place. The outer diameter of the spindle fits in the center aperture of a roll of toilet paper, allowing the roll to unwind and dispense toilet paper.

These spindles are typically designed for standard rolls of toilet paper that have a cardboard paper core approximately 1½ inches (3.8 cm) in diameter. The toilet paper is wound over the cardboard paper core, generally until the outer diameter reaches approximately 4½ in diameter (11.4 cm).

In order to prevent pilferage of toilet paper in commercial settings, either by the bathroom user or maintenance staff, manufacturers of commercial rolls of toilet paper have produced "solid-core," "coreless," and "reduced-core" toilet paper rolls. As used herein, "solid-core" means a roll of product that has substantially no center aperture. As used herein, "coreless" means a roll of product having no separate core material (e.g., cardboard core for toilet paper). "Coreless" also generally implies that the center aperture of the roll of product is less than that of a similar size roll having a core, although this may not always be the case. As used herein, "reduced-core" means a roll of product that has a core diameter substantially smaller than a standard or common core diameter (e.g., 1½ inches for residential-use toilet paper rolls). Solid-core, coreless, and reduced core toilet paper rolls discourage theft of the rolls since the rolls cannot be used with most residential toilet paper roll dispensers and spindles.

The typical spindle design described above (i.e., two elongated members that snap fit together with a spring inside) is not well suited for rolls having smaller center apertures since a snap fit connection looses effectiveness as dimensions are reduced. The snap fit connection becomes more fragile as the diameter of the elongated member is reduced. The snap fit connection also becomes more fragile as the thickness of the wall of the elongated member is increased in order to have enough strength to hold the paper product during use. This thicker wall is less flexible and can crack when the two parts are snapped together. Numerous spindle designs for coreless paper product rolls are known. U.S. Pat. No. 5,467,935 to Moody, for example, describes a spindle for dispensing coreless rolls of toilet paper. The spindle incorporates a stop mechanism to prevent the roll from making complete revolutions, thus limiting the amount of toilet paper that can be dispensed in order to reduce usage and save money. Other spindle designs are taught in U.S. Pat. Nos. 1,391,326, 1,778,856, 2,209,471, 2,289,453, 2,289,519, 2,331,743, 2,621,867, 2,762,575, 3,770,221, 4,212,434, 4,447,015, 6,422,505, D0340822, International Patent Application Publication No. WO 2009/027873, and Great Britain Patent No. 731449.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

All known prior art has failed to provide an expandable/contractible spindle design that is well suited for rolls having reduced diameter center apertures. The spindle disclosed in Moody, for example, is overly complex and the stop feature is undesirable for most users. It has yet to be appreciated that an expandable/contractible spindle can be provided that does not rely on snap connections.

Thus, there is still a need for an improved expandable/contractible spindle that can be used with rolls of paper products having reduced diameter center apertures.

SUMMARY OF THE INVENTION

The inventive subject matter provides apparatus, systems and methods in which an expandable and contractible spindle for dispensing a roll of paper product includes a first elongated housing slideably coupled with a second elongated housing. The first elongated housing has a hollow interior portion and a side opening leading to the hollow interior. The second elongated housing has at least three portions with different diameters (or local maximum diameters), namely, first, second, and third outer diameters. The first outer diameter is smaller than the inner diameter of the first elongated housing, but larger than the side opening diameter of the first elongated housing. The second outer diameter is smaller than the side opening diameter of the first elongated housing. The third outer diameter is larger than the side opening diameter of the first elongated housing. The diameters and other dimensions of the first and second housings are such that an end of the second housing fits inside the hollow interior of the first housing, and first and second housings can slide with respect to one another, preferably in a coaxial manner. A spring is disposed in the hollow interior such that first and second housings are biased in an expanded configuration.

In some aspects of preferred embodiments, first elongated housing consists of two halves removeably coupled together via internal threads on the first half that couple with external threads on the second half. In other embodiments, first elongated housing consists of a top half and bottom half that can be permanently joined together around the first diameter portion of the second housing. In some embodiments, the top half and bottom half are joined by either ultrasonic welding or gluing. However, all known methods suitable for permanently joining two parts together are contemplated.

Contemplated spindles can be inserted into a center aperture of rolls of paper products, including, but not limited to, toilet paper rolls, towel/tissue rolls, rolls of stamps, and rolls of tickets.

In other aspects of some preferred embodiments, the spindle ends are configured to fit into recessed portions on walls of a dispenser or on arms of a spindle holder. In this manner, the spindle can be quickly loaded and/or removed by expanding and contracting the spindle from the recessed portions. It is also contemplated that the ends of the spindle could be configured to removeably engage with configurations other than recesses (e.g., male-female fasteners). In addition, the spindle ends are preferably configured to engage dispensers originally designed for rolls of paper product that have a core, and thus a larger center aperture diameter. In this embodiment, the spindle serves as an adapter for retrofitting core roll dispensers with coreless or reduced core rolls of paper product.

In yet other aspects, the spindle preferably has a maximum outer diameter of less than 1 inch (2.5 cm), more preferably less than ½ inch (1.3 cm), most preferably less than ⅜ inch (1 cm). However, the inventive concepts discussed herein can be applied to much larger dimensions, if so desired. The maximum outer diameter of the first elongated housing is preferably equal to the maximum outer diameter of the second elongated housing.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
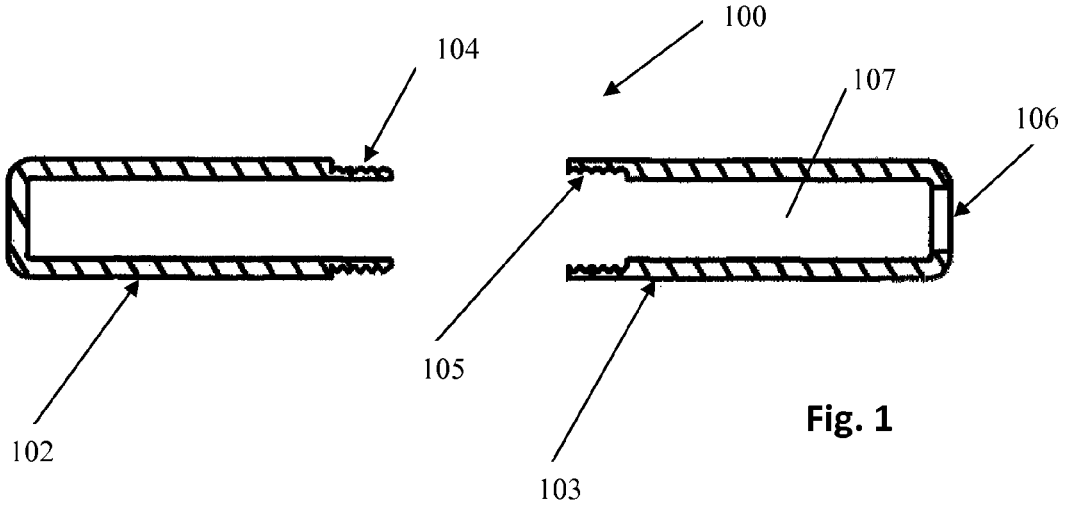
FIG. 1 is a side section view of an unassembled first elongated housing for a spindle assembly.
Figure 2:
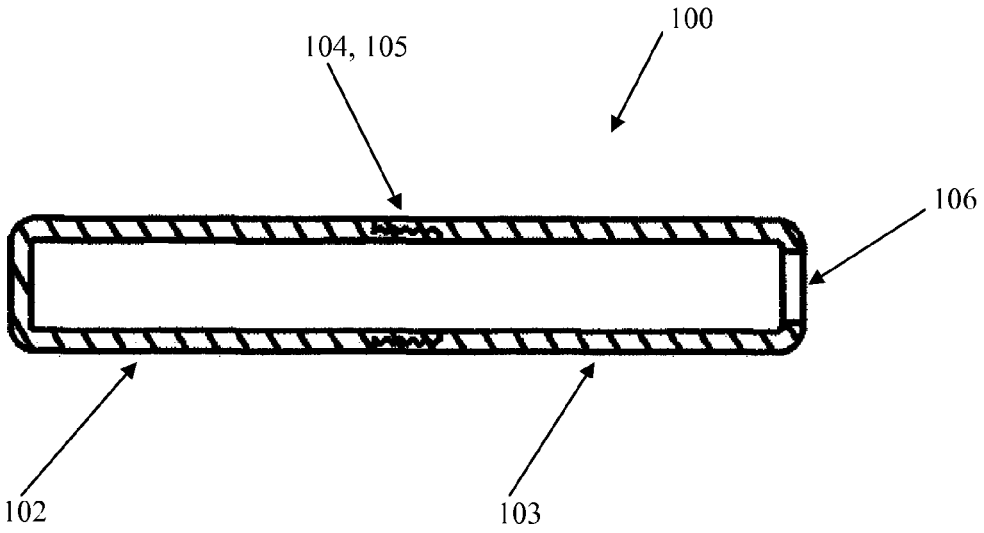
FIG. 2 is a side section view of the housing in FIG. 1 in an assembled state.

FIG. 1 shows a side section view of first elongated housing 100. Housing 100 comprises a first half 102 and second half 103. First half 102 has external threads 104 that mate with internal threads 105 on second half 103. Housing 100 also includes an opening 106 leading to a hollow interior 107. FIG. 2 is a side section view of first elongated housing 100 in an assembled state.

Figure 3:
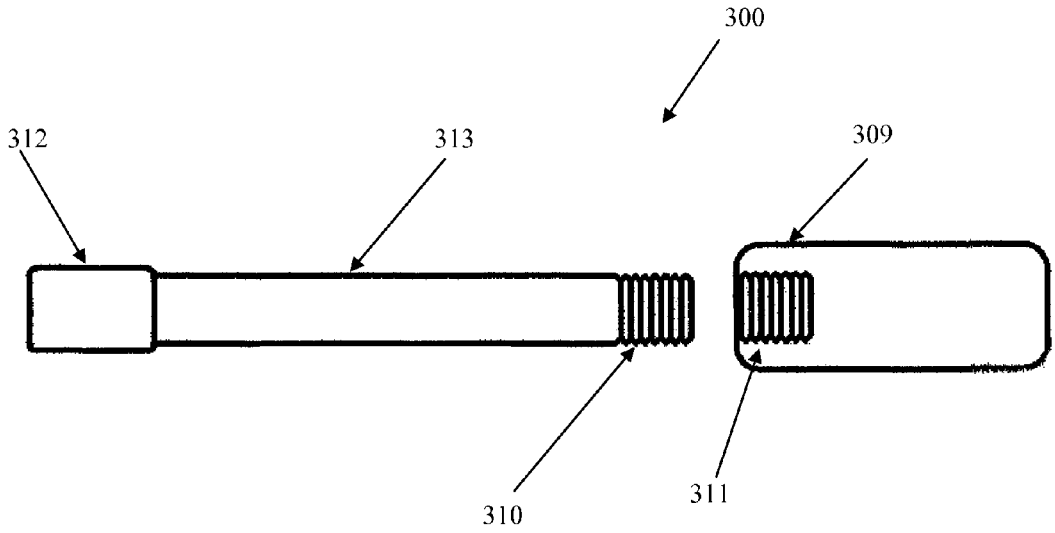
FIG. 3 is a side view of an unassembled second elongated housing for a spindle assembly.
Figure 4:
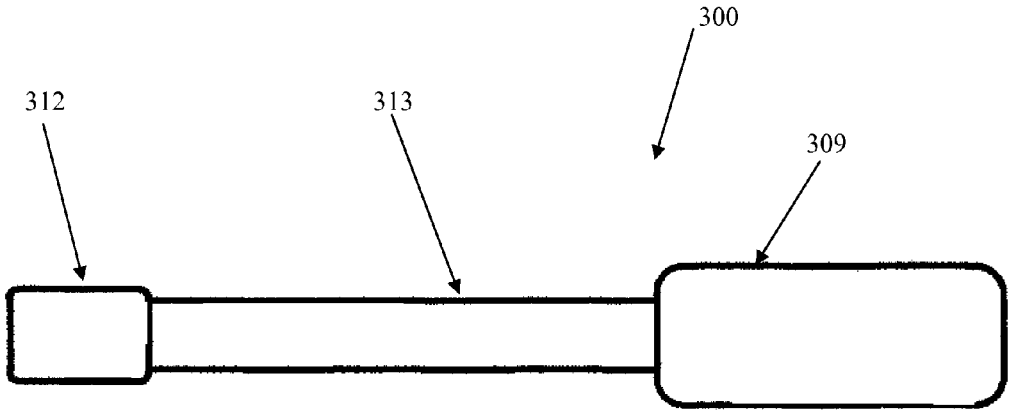
FIG. 4 is a side view of the second elongated housing of FIG. 3 in an assembled state.

FIG. 3 shows a second elongated housing 300. Housing 300 includes a first outer diameter portion 312, second outer diameter portion 313, and third outer diameter portion 309. Portion 309 has internal threads 311 that mate with external threads 310 on portion 313. FIG. 4 shows housing 300 in an assembled state.

Figure 5:
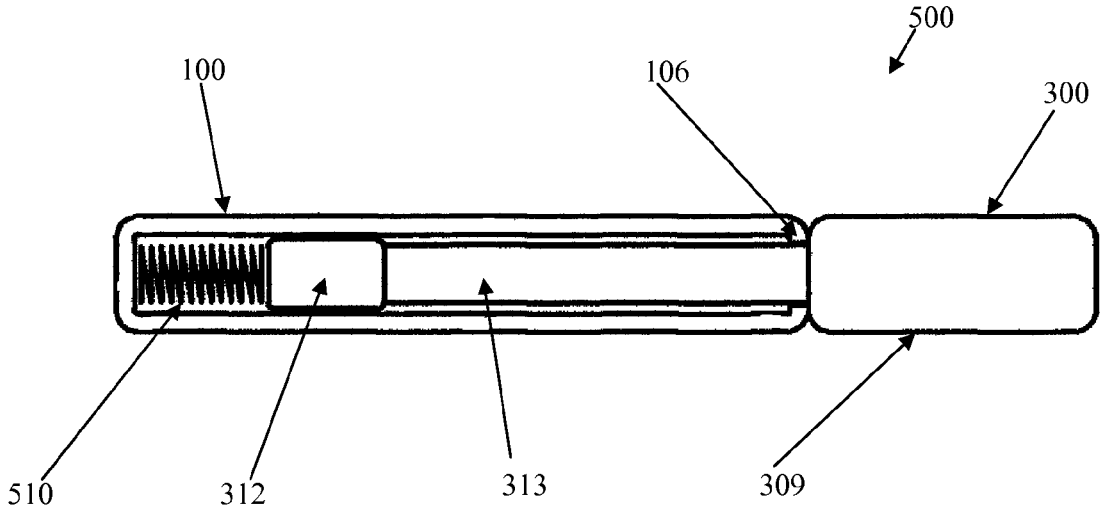
FIG. 5 is a side section view of a spindle assembly made from the first elongated housing of FIG. 1, second elongated housing of FIG. 3, and a spring in a compressed state.
Figure 6:
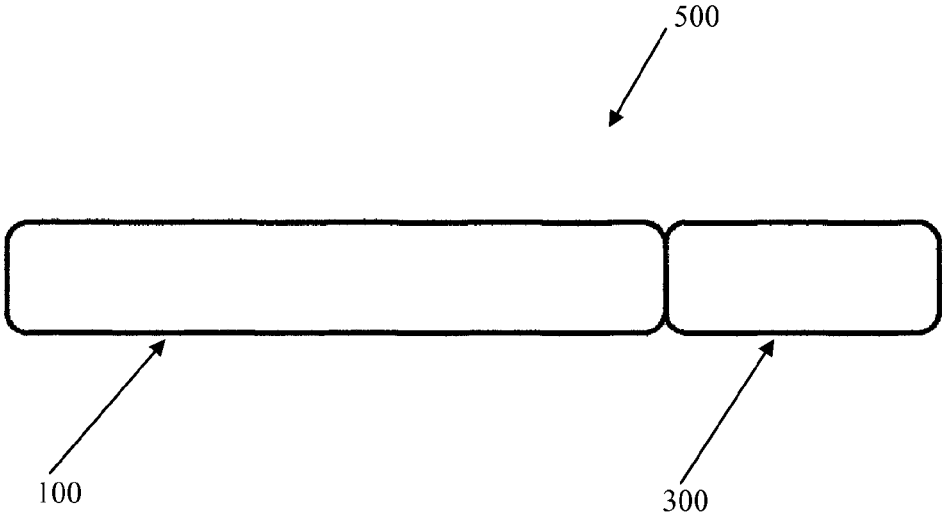
FIG. 6 is a side view of the spindle assembly of FIG. 5.

FIG. 5 shows a side section view of spindle assembly 500. Spindle assembly 500 is the combination of housing 100, housing 300, and spring 510. Portions 312 and 313 of housing 300 have been disposed in hollow portion 107 (see FIG. 1) of housing 100. Spring 510 has also been disposed in hollow portion 107 and is compressed such that it opposes housing 300 from sliding into housing 100. FIG. 6 shows a side view of spindle assembly 500.

Spindle assembly 500 is assembled by: (1) disassembling housing 100 (see FIG. 1); (2) disassembling housing 300 (see FIG. 3); (3) inserting portion 312 of housing 300 through opening 106 of housing 100 until portion 312 is completely disposed in hollow portion 107; (4) placing spring 510 in hollow portion 107; (5) assembling first housing 100 (i.e., connecting first half 102 with second half 103); and (6) assembling housing 300 (i.e., connecting portion 309 with portion 313).

Figure 11:
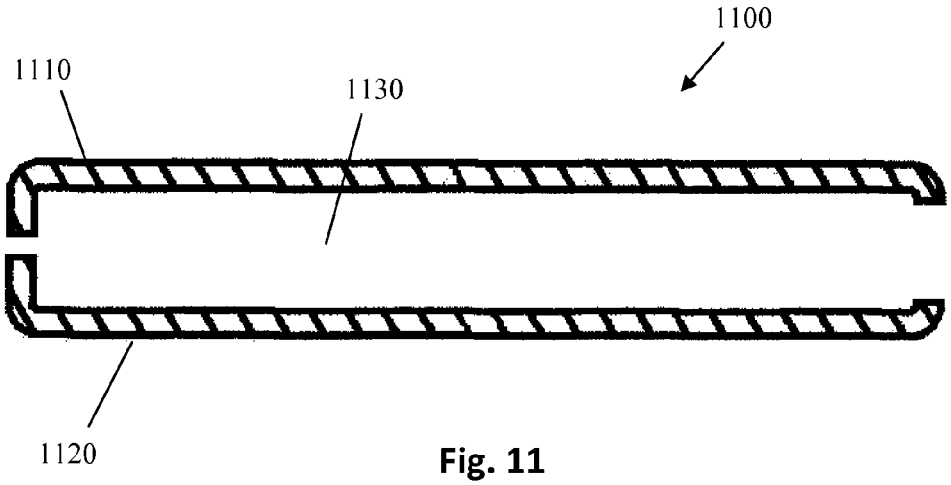
FIG. 11 is a side section view of another embodiment of a first elongated housing.
Figure 12:
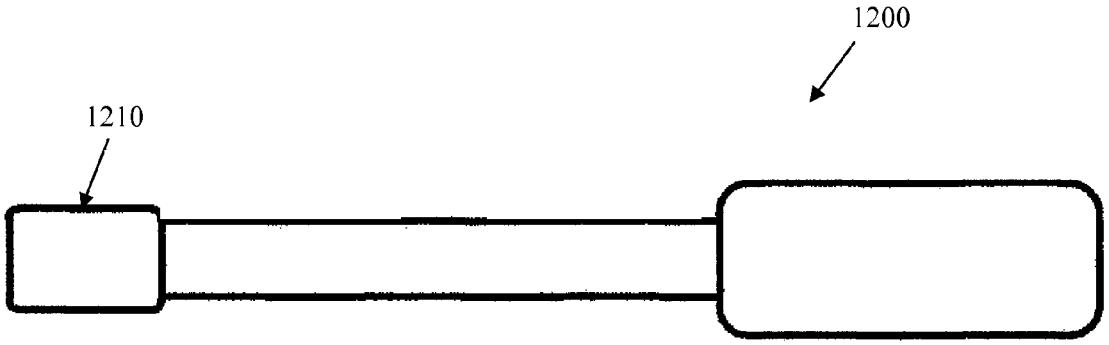
FIG. 12 is a side section view of another embodiment of a second elongated housing.

Those of skill in the art will appreciate that numerous variations in the design of housings 100 and 300 can be used consistently with the inventive concepts disclosed herein. For example, in an alternative embodiment, housing 100 could comprise a top half and a bottom half with no external/internal threads, such as housing 1100 shown in FIG. 11. Housing 1100 has a top half 1110 and a bottom half 1120. Furthermore, housing 300 could comprise one solid part (i.e., no external and internal threads), such as housing 1200 shown in FIG. 12. In this embodiment, the spindle assembly would be assembled by: (1) placing portion 1210 of housing 1200 in the hollow portion 1130 of bottom half 1120; (2) placing spring 510 in the hollow portion 1130 of bottom half 1120; (4) placing top half 1110 over spring 510 and portion 1210; and (5) joining top half 1110 with bottom half 1120 (e.g., ultrasonic welding).

Housings 100 and 300 can be made of any material suitable for supporting a roll of paper product. Materials may include, but are not limited to, plastics, polymers, metal alloys, composites, ceramic, and wood. The materials and dimensions are preferably chosen such that a significant amount of force is required to pull portion 312 out of opening 106 (see FIG. 5). In other words, opening 106 should have sufficient rigidity such that an average human could not easily pull portion 312 out of opening 106.

While portions 309, 312, and 313 of housing 300 all have constant diameter sizes throughout each portion, variable diameter profiles are also possible. For example, portion 313 could have a convex profile. When the portions of housing 300 have variable diameters, the "diameter of portion [number]" refers to a local maximum diameter (i.e., the greatest diameter of that portion. The spindle assembly configurations disclosed herein can achieve diameters as small as ⅜ inches (1 cm), or even smaller, since the snap fit connection has been eliminated from the design. While small diameter sizes are of specific interest in this application, those of skill in the art will appreciate that the inventive concepts taught herein can be applied to much larger spindle sizes.

The outer diameters of portions 309 and 312 are larger than the diameter of opening 106, while the diameter of portion 313 is smaller than opening 106. This allows second elongated housing to slide axially and rotate with respect to first elongated housing 100. Portions 312 and 309 serve as stops and prevent the housings from sliding further in either direction.

Figure 7:
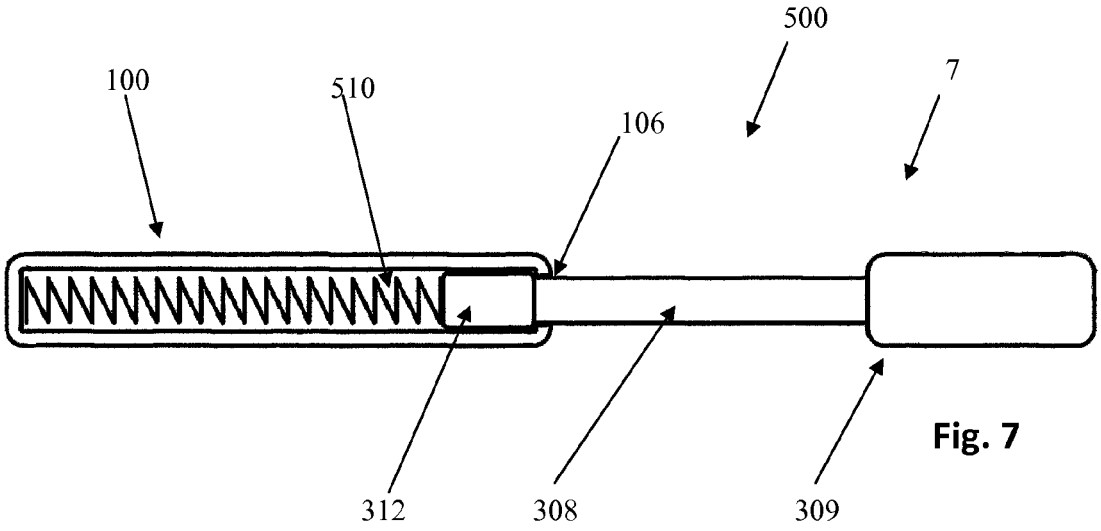
FIG. 7 is a side section view of the spindle assembly of FIG. 5, with the spring in an expanded state.
Figure 8:
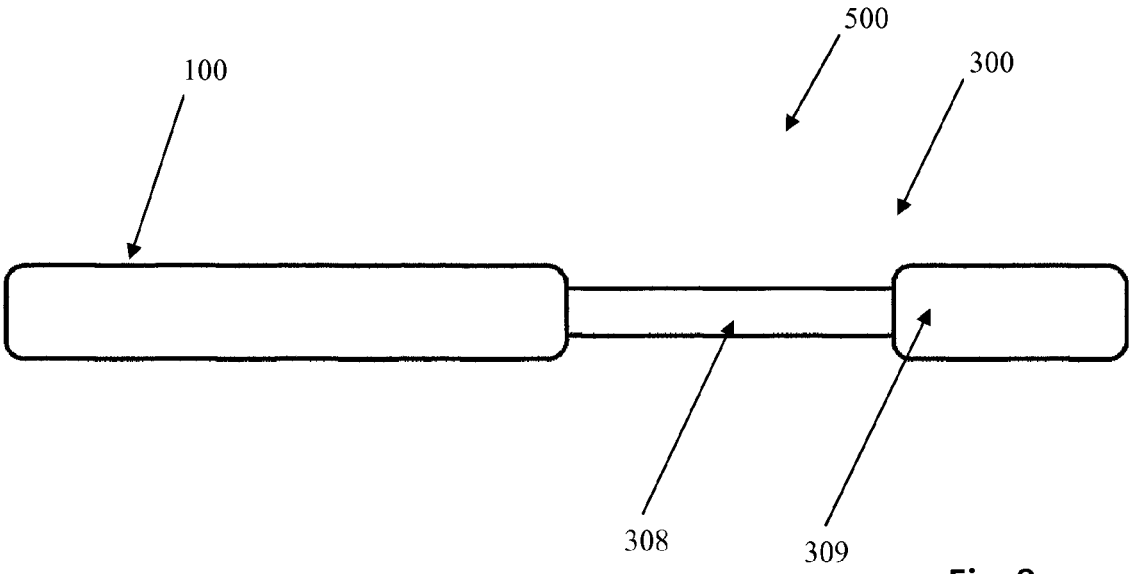
FIG. 8 is a side view of the spindle assembly of FIG. 7, with the spring in an expanded state.

FIG. 7 shows a side section view of spindle assembly 500 with spring 510 in an expanded state. FIG. 8 shows a side view of spindle assembly 500 in an expanded state.

Figure 9:
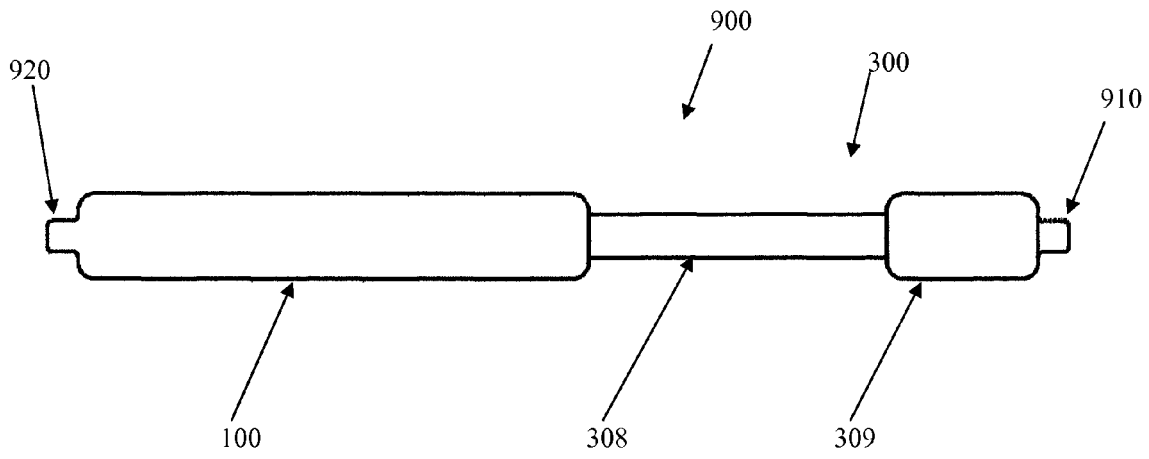
FIG. 9 is a side view of another embodiment of a spindle assembly, in which the spindle ends have small diameter protrusions for engaging recessed portions of a dispenser.
Figure 10:
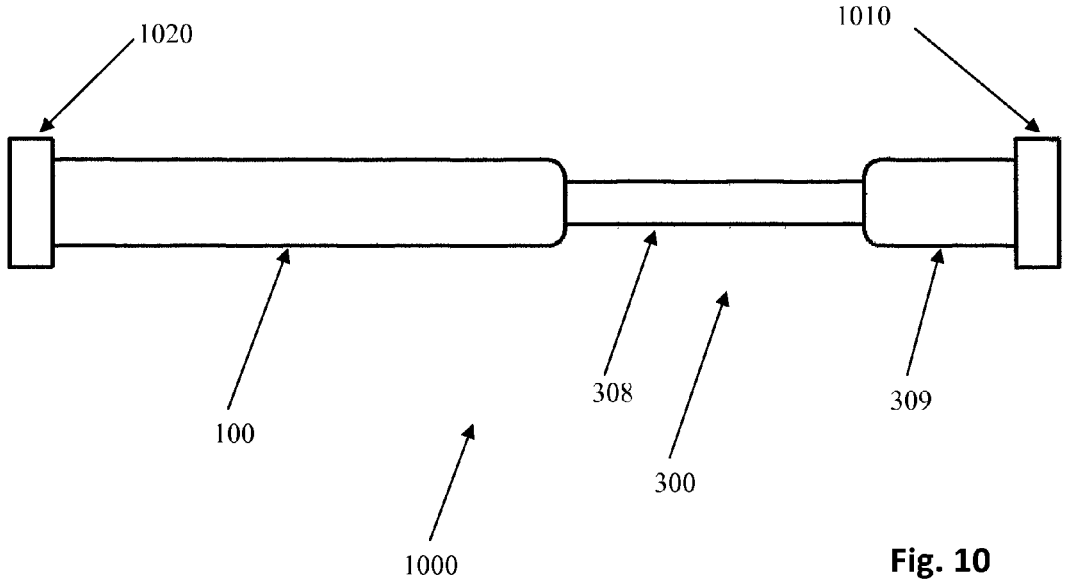
FIG. 10 is a side view of another embodiment of a spindle assembly, in which the spindle ends have large diameter protrusions for engaging recessed portions of a dispenser.

FIG. 9 shows a side view of spindle assembly 900. Unlike spindle assembly 500, spindle assembly 900 has first and second end protrusions 910 and 920. Protrusions 910 and 920 have a smaller diameter than the diameter of portion 309 and housing 100, respectively. Protrusions 910 and 920 are configured to mate with a particular size and dimension of recessed portions of a dispenser. Likewise, FIG. 10 shows a side view of a spindle assembly 1000, which has first and second protrusions 1010 and 1020 that have larger diameters than portion 309 and housing 100, respectively. One of skill in the ark will appreciate that numerous sizes, shapes, and configurations of end protrusions can be used without departing from the inventive subject matter disclosed herein. In preferred embodiments, protrusions 1010 and 1020 are configured to mate with a dispenser that was originally designed to hold spindle assemblies having a much larger outer diameter than spindle assembly 1000. In this manner, spindle assembly 1000 serves as an "adapter," meaning that dispensers originally designed to hold rolls of paper product having a "standard" size center aperture can be retrofitted with spindle assembly 1000 to allow the dispenser to be used with rolls having a non-standard size center aperture.

Figure 13:
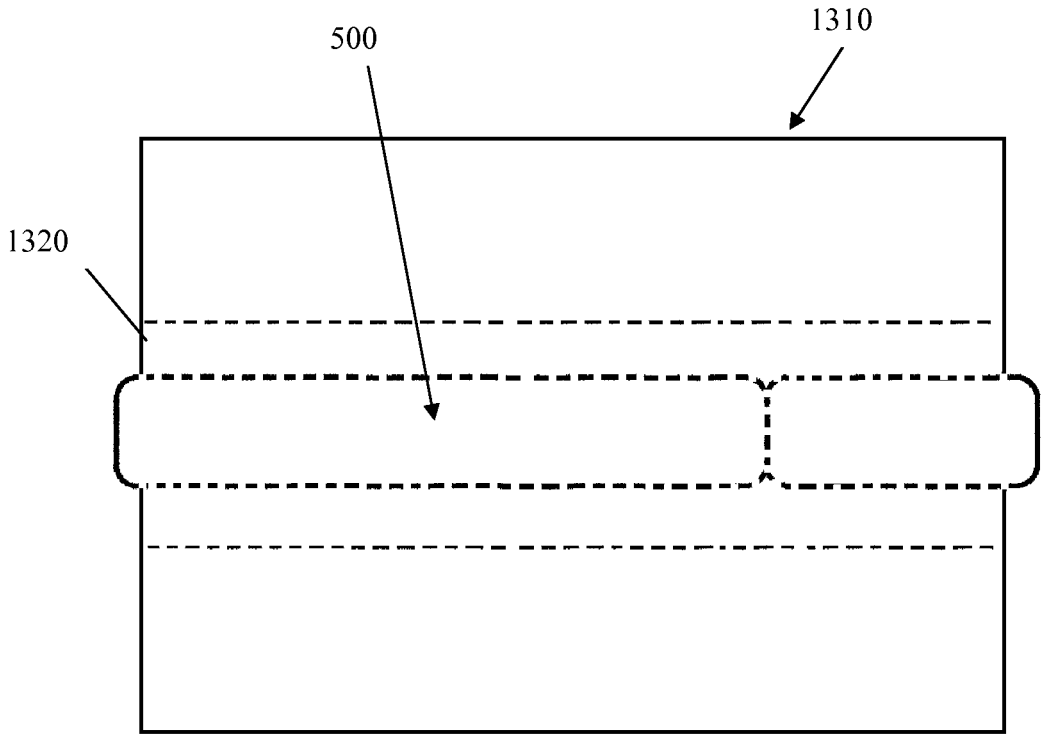
FIG. 13 is a side view of a roll of paper product with the spindle of FIG. 5 inserted in a center aperture of the roll.

FIG. 13 shows a side view of a roll of paper product 1310 that has a center aperture 1320. Spindle assembly 500 has been inserted in center aperture 1320. When the ends of spindle assembly 500 are secured, roll 1310 can be unwound by pulling on a web of roll 1310. Those of skill in the art will appreciate that the design of spindle 500 can be used to unwind rolls other than paper products. As such, the inventive subject matter is not intended to be limited to absorbent material, such as toilet paper. "Roll of paper products" could include rolls of stamps, tickets, and even non-absorbent and/or non-paper products (e.g., rolls of plastic wrap or aluminum foil).

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A spindle for dispensing a roll of paper product, comprising:

a first elongated housing having an outer diameter, an inner diameter, and a side opening having a diameter;

wherein the first elongated housing comprises first and second separate members that couple to form a hollow interior portion;

a second elongated housing consisting of a first end portion, a middle portion, and a second end portion having first, second, and third outer diameters, respectively;

wherein the first outer diameter of the second elongated housing is smaller than the inner diameter of the first elongated housing and larger than the side opening diameter of the first elongated housing;

wherein the second outer diameter of the second elongated housing is smaller than the side opening diameter of the first elongated housing;

wherein the third outer diameter of the second elongated housing is larger than the side opening diameter of the first elongated housing;

wherein the second end portion has a constant diameter that extends from the middle portion to an end of the second elongated housing; and a spring having a diameter smaller than the first elongated housing inner diameter, wherein the spring is disposed in the hollow interior portion of the first elongated housing between the first elongated housing and the second elongated housing and biased to expand the first elongated housing away from the second elongated housing.

2. The spindle of claim 1, wherein the first outer diameter portion of the second elongated housing and the spring are disposed in the hollow interior portion of the first elongated housing.

3. The spindle of claim 2, wherein the spring is disposed in the hollow interior portion such that it opposes the second elongated housing from sliding in the hollow interior portion.

4. The spindle of claim 1, wherein the first and second elongated housings are at least partly disposed in a center aperture of the roll of paper product.

5. The spindle of claim 1, wherein an end of the first elongated housing and an end of the second elongated housing are configured to removably couple with first and second recessed portions, respectively, of a paper product dispenser.

6. The spindle of claim 1, further comprising a spindle holder having a first arm with a first recessed portion and a second arm with a second recessed portion, and wherein an end of the first elongated housing and an end of the second elongated housing are configured to removeably couple with the first and second recessed portions, respectively.

7. The spindle of claim 1, wherein first elongated housing and second elongated housing are coaxial.

8. The spindle of claim 7, wherein first elongated housing is axially slideable with respect to the second elongated housing.

9. The spindle of claim 1, wherein the outer diameter of the first elongated housing is constant from a first end to a second end of the first elongated housing.

10. The spindle of claim 1, wherein the sum of the first, second, and third lengths is substantially equal to the length of the first elongated housing.

11. The spindle of claim 1, wherein the second length is equal to the sum of the first and third lengths.

12. The spindle of claim 1, wherein the spring has a length greater than a length of the hollow inner portion minus the length of the first outer diameter of the second elongated housing.

13. The spindle of claim 1, wherein the first elongated housing is substantially non-flexible.

14. The spindle of claim 1, wherein the second outer diameter of the second elongated housing is disposed between first and third outer diameters of the second elongated housing.

15. The spindle of claim 1, wherein the third outer diameter of the second elongated housing is equal to the outer diameter of the first elongated housing.

16. A spindle for dispensing a roll of paper product, comprising:

a first elongated housing having first and second separate members that couple to form an interior portion having an opening, wherein the first elongated housing comprises an outer diameter that is constant;

a second elongated housing consisting of a first end portion, a middle portion, and a second end portion;

wherein the first end portion is (a) disposed within the interior portion and (b) larger than the opening;

wherein the middle portion passes through the opening when the spindle is assembled;

wherein the second end portion is larger than the opening, wherein the second end portion comprises an outer diameter that is constant; and a spring disposed within the interior portion between the first elongated housing and the second elongated housing and biased to expand the first elongated housing away from the second elongated housing; wherein the first member comprises an internal thread and the second member comprises an external thread that couples with the internal thread of the first member.

17. A method for assembling a spindle for dispensing a roll of paper product, wherein the spindle comprises:

a first elongated housing having first and second members that couple to form an interior portion, wherein the first member comprises a bottom portion of the first elongated housing and the second member comprises a top portion of the first elongated housing;

a second elongated housing having a first end portion; and a spring:

the method comprising:

placing the first end portion of the second elongated housing in the interior portion of the first member of the first elongated housing;

placing the spring in the interior portion of the first member of the first elongated housing;

placing the second member of the first elongated housing on top of the spring and the first end portion of the second elongated housing disposed in the interior portion of the first member of the first elongated housing; and coupling the first and second members of the first elongated housing to thereby affix the top and bottom portions of the elongated housing.

18. The method of claim 17, wherein the step of coupling the first and second members of the first elongated housing comprises at least one of:

ultrasonic welding the first and second members together; and gluing the first and second members together.

* * * * *